US011031199B2

(12) United States Patent
Bradler et al.

(10) Patent No.: US 11,031,199 B2
(45) Date of Patent: Jun. 8, 2021

(54) SWITCHING CONTACT DRIVE DEVICE AND SWITCHING DEVICE

(71) Applicant: SIEMENS AKTIENGESELLSCHAFT, Munich (DE)

(72) Inventors: Christian Bradler, Berlin (DE); Alexander Rose-Poetzsch, Panketal (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 16/643,888

(22) PCT Filed: Aug. 20, 2018

(86) PCT No.: PCT/EP2018/072387
§ 371 (c)(1),
(2) Date: Mar. 3, 2020

(87) PCT Pub. No.: WO2019/048220
PCT Pub. Date: Mar. 14, 2019

(65) Prior Publication Data

US 2020/0273644 A1 Aug. 27, 2020

(30) Foreign Application Priority Data

Sep. 5, 2017 (DE) ..... 102017215601

(51) Int. Cl.
*H01H 33/40* (2006.01)
*H01H 3/30* (2006.01)

(52) U.S. Cl.
CPC ..... *H01H 33/40* (2013.01); *H01H 3/3052* (2013.01); *H01H 2003/3068* (2013.01); *H01H 2003/3073* (2013.01)

(58) Field of Classification Search
CPC ..... H01H 33/40; H01H 3/3052; H01H 2003/3068
USPC ..... 200/402; 218/152, 153, 154, 44, 45
See application file for complete search history.

(56) References Cited

U.S. PATENT DOCUMENTS

| | | | | |
|---|---|---|---|---|
| 2,778,450 | A | 1/1957 | Debuit | |
| 5,280,258 | A * | 1/1994 | Opperthauser | H01H 3/3021 200/400 |
| 6,437,276 | B1 | 8/2002 | Bruchmann et al. | |
| 2009/0166938 | A1 | 7/2009 | Westfalt et al. | |
| 2012/0199456 | A1* | 8/2012 | Tak | H01H 3/3021 200/400 |
| 2012/0199546 | A1 | 8/2012 | Tak | |

FOREIGN PATENT DOCUMENTS

| | | | |
|---|---|---|---|
| CN | 101471189 | A | 7/2009 |
| DE | 102011078365 | A1 | 1/2013 |
| EP | 3093862 | A1 | 11/2016 |

* cited by examiner

*Primary Examiner* — Edwin A. Leon
*Assistant Examiner* — Iman Malakooti
(74) *Attorney, Agent, or Firm* — Laurence Greenberg; Werner Stemer; Ralph Locher

(57) ABSTRACT

A switching contact drive device contains a transmission with an energy store. The energy store is enclosed in a housing. The housing guides a relative movement, particularly a deformation of the energy store. The switching contract drive device is provided for driving an electrical switching device such as a circuit breaker.

9 Claims, 2 Drawing Sheets

SWITCHING CONTACT DRIVE DEVICE AND SWITCHING DEVICE

BACKGROUND OF THE INVENTION

Field of the Invention

The invention relates to a switching contact drive device comprising a transmission with an energy store for an electrical switching device.

A switching contact drive device is known, for example, from published patent application DE 10 2011 078 365 A1. A transmission with an energy store is described herein. The energy stored in the energy store is used to execute a movement of the switching contact points relative to one another. In order to permit the delivery of a required motion profile, a motion control function can be executed by the transmission. Any requisite changes to the motion profile are generally associated with complex mechanical adjustments. Specifically, changes in the capacity of the energy store are frequently associated with consequential adjustments.

SUMMARY OF THE INVENTION

The object of the invention is thus the disclosure of a switching contact drive device, the energy store of which can be altered in a simple manner.

According to the invention, this object is fulfilled by the characteristics of the independent patent claim.

Electrical switching devices can comprise switching contact points which are moveable relative to one another, in order to execute the switching of a current path. The drive energy required for this purpose is delivered by a switching contact drive device. In order to permit the reliable execution of a relative movement of the switching contact points, independently of external circumstances, the switching contact drive device comprises an energy store. Further to a previous charging of the energy store, energy can be tapped from the latter in order to drive a relative movement between the switching contact points. By way of energy stores, various structures can be employed (e.g. chemical, thermal or mechanical energy stores). However, mechanical energy stores have proved to be particularly reliable. Mechanical energy stores can be charged by means of deformation, wherein a recovery of energy can be executed e.g. by a reforming of the energy store.

A store housing protects the energy store against external forces. Particularly in the case of a deformation of a mechanical energy store, e.g. a spring, the store housing additionally prevents any break-out or uncontrolled discharge of the energy store. The store housing can enclose the energy store in the manner of a cage. By means of the store housing, the energy store is provided with mechanical protection, which can be employed to direct a movement, for example during a deformation of the energy store. Accordingly, a predefined motion path can be imposed upon the energy store, as a result of which the latter is protected against spurious charging or spurious movements. In consequence, firstly, the store housing ensures protection against forces acting from the exterior and, secondly, the store housing can also guide a movement of the energy store. Moreover, the store housing protects the environment in the event of any malfunctions of the energy store.

Advantageously, it can further be provided that the store housing directs a relative movement, specifically a deformation of the energy store.

During a charging or discharging of the energy store, the latter can undergo a movement, specifically a deformation. Energy stores which are charged or discharged by means of a relative movement are e.g. mechanical energy stores, such as springs of various designs (e.g. coil springs, torsion springs, gas pressure springs, etc.). Depending upon the quantity of energy to be stored or the design of the energy store, the energies acting upon the energy store for the purposes of charging can be relatively high. Specifically, during the short time intervals in which a charging of the energy store is executed, a high stress loading can be applied to the latter. In order to reduce the loading of the energy store, and to provide a switching contact drive device with long-term stability, a permanently consistent movement of the energy store must be ensured. By means of the store housing, a relative movement of the energy store can be directed. Particularly during charging and discharging, the speed of charging or discharging can be increased, as a relative movement of the energy store is guided by the store housing. Correspondingly, any break-out or malfunctions of the energy store during charging or discharging are counteracted. Specifically, in an embodiment of the store housing in the manner of a cage, any break-out of the energy store can thus be prevented. Accordingly, for example, in the event of malfunctions, for example a failure of the energy store, mechanical protection of the environment against a failed energy store is additionally provided by the store housing. Depending upon the shaping of the store housing, various types of charging or discharging movements of the energy store can be supported or provided such that, by the selection of shape, for example the circumference or length of the store housing, a variation of the energy store can also be executed. Thus, optionally, shorter or longer springs, different designs of energy stores etc. can be employed wherein, depending upon the design, different types of store housing can be used. Correspondingly, a modular structure of the store housing can be provided, wherein the store housing, as an element of the transmission, can be flange-mounted, for example, onto a transmission housing, such that a modification of the energy store or of the store housing can be undertaken in a simple manner. The transmission housing can also constitute a section (module) of the store housing.

Advantageously, it can further be provided that the store housing, transversely to a relative movement of the energy store, incorporates a joining point.

By an arrangement of a joining point transversely to the relative movement of the energy store, an option is provided for the variation of the dimensions or the holding capacity of the store housing. The store housing, for example, can thus be comprised of modules, wherein a joining point is arranged between the modules.

Correspondingly, it is possible, depending upon requirements, to enclose larger or smaller energy stores in a store housing of identical design, but which is comprised of different modules. By means of a modular structure of the store housing, identical components can be employed for the constitution of different types of switching contact drive devices with different switching capacities. The joining point can be configured, for example, as a butt joint between different sections (modules) of the store housing. However, it can also be provided that the joining point is closed, e.g. by means of a materially bonded joining process, or is bridged, in the interests of further increasing the stability of the store housing.

Advantageously, it can further be provided that a gate passage for guiding a movement of the energy store is arranged transversely to the joining point.

By means of a gate passage, a movement along the trajectory thereof can be compelled. Thus, for example, a relative movement of the energy store in a specific form can be determined by means of a gate passage. The storage housing can thus be employed for the direction/control of a relative movement of the energy store. By a crossing of a joining point, the relative movement can be varied in accordance with the number and/or shape of the modules employed for the store housing. The possibility is further provided, by a routing of a gate passage over a joining point, for the compulsion of different forms of movement in the various modules, by the variation of different sections of the gate passage. A mechanical programming of a store charging or discharging process is thus permitted in a simple manner.

Advantageously, it can further be provided that the store housing is mounted on a mating surface of a transmission housing.

A transmission housing comprises, for example, transmission elements which convert the energy delivered by the energy store, or which introduce the requisite movement into the energy store for the charging of the energy store. By the employment of a mating surface of the transmission housing as a counter bearing (abutment) for a store housing, firstly, a relative position of the energy store to the transmission housing is defined. Moreover, a joining point can be arranged between the store housing and the transmission housing, which is traversed by a gate passage. The transmission housing can function as a module of the store housing.

According to a further advantageous configuration, it can be provided that the gate passage is centered in a mating surface by means of form-fitting elements.

By the employment of form-fitting elements, it is possible for the gate passage to be routed across a joining point, and for an adequate guide function to also be ensured by the gate passage in the region of the joining point. Correspondingly, for example, by an attachment of the individual modules of the store housing in relation to one another, or also of the store housing to the transmission housing, a relative position of the energy store and the transmission housing can be assuredly defined. By means of the form-fitting elements, an interlocking of one part (module), by way of complementary shaping, in another part (e.g. a further module or a transmission housing) in the region of the joining point can be ensured.

A further object of the invention is the disclosure of an appropriate application for a switching contact drive device. According to the invention, in an electrical switching device having a first and second switching contact point, which are moveable relative to one another, it is provided, for the generation of a relative movement between the switching contact points of the switching device, that a switching contact drive device according to one of the above-mentioned forms of embodiment is employed.

The function of a switching device is a switching of a current path. To this end, the switching device, in a current path, can comprise a first and a second switching contact point, wherein the two switching contact points are moveable relative to one another. By a contact connection of the two switching contact points, a closed state can be constituted in the current path of the switching device. By a mutual separation of the switching contact points, a breakpoint can be constituted in the current path. A relative movement of the switching contact points in relation to one another is permitted by an introduction of a movement. For the generation of a relative movement between the switching contact points, a switching contact drive device according to the invention is assigned to the switching device. The switching contact drive device comprises an energy store, which forms part of a transmission. The energy store is, for example, a mechanical energy store in the form of a spring. By a charging of the energy store (e.g. a compression or expansion of the spring), energy can be stored in the energy store. This provides the advantage in that, even in the event of a malfunction of an external energy supply, an independent energy store is available, which provides energy for a limited number of switching operations, e.g. protective switching operations such as disconnections, etc. In the event of switching, energy is tapped from the energy store, and is converted into kinetic energy in the form of a relative movement of the contact points in relation to one another. The energy store is thus an element of the transmission. Depending upon the configuration of the transmission, a plurality of energy stores can also be provided which, for safety reasons, operate in parallel, or can also execute various switching movements (e.g. an energy store for a closing movement, or an energy store for an opening movement).

Depending upon the switching function of the electrical switching device, e.g. as a circuit-breaker, a load interrupter switch, an isolating switch, a grounding switch or a positional grounding switch, the motion profiles required can vary. Moreover, depending upon the voltage level or the current-carrying capacity of the switching contact points, different requirements may be defined for the energy which is to be held in the energy store for the execution of a switching movement. By the employment of a store housing, an energy store can be fixed in position whereas, in the store housing of a modular structure, the dimensions of the store housing can be varied. Thus, e.g. in the event of the employment of coil springs with different numbers of coil turns, and correspondingly different energy storage capacities, the store housing can be slightly modified.

An exemplary embodiment of the invention is schematically represented in a drawing, and is described in greater detail hereinafter.

BRIEF DESCRIPTION OF THE SEVERAL VIEWS OF THE DRAWING

FIG. 1 shows a switching contact drive device, and a switching device; which FIG. 2 shows a module of a store housing, as in the switching contact drive device according to FIG. 1, viewed in the direction of a joining point surface, and which

DETAILED DESCRIPTION OF THE INVENTION

Figure 1:
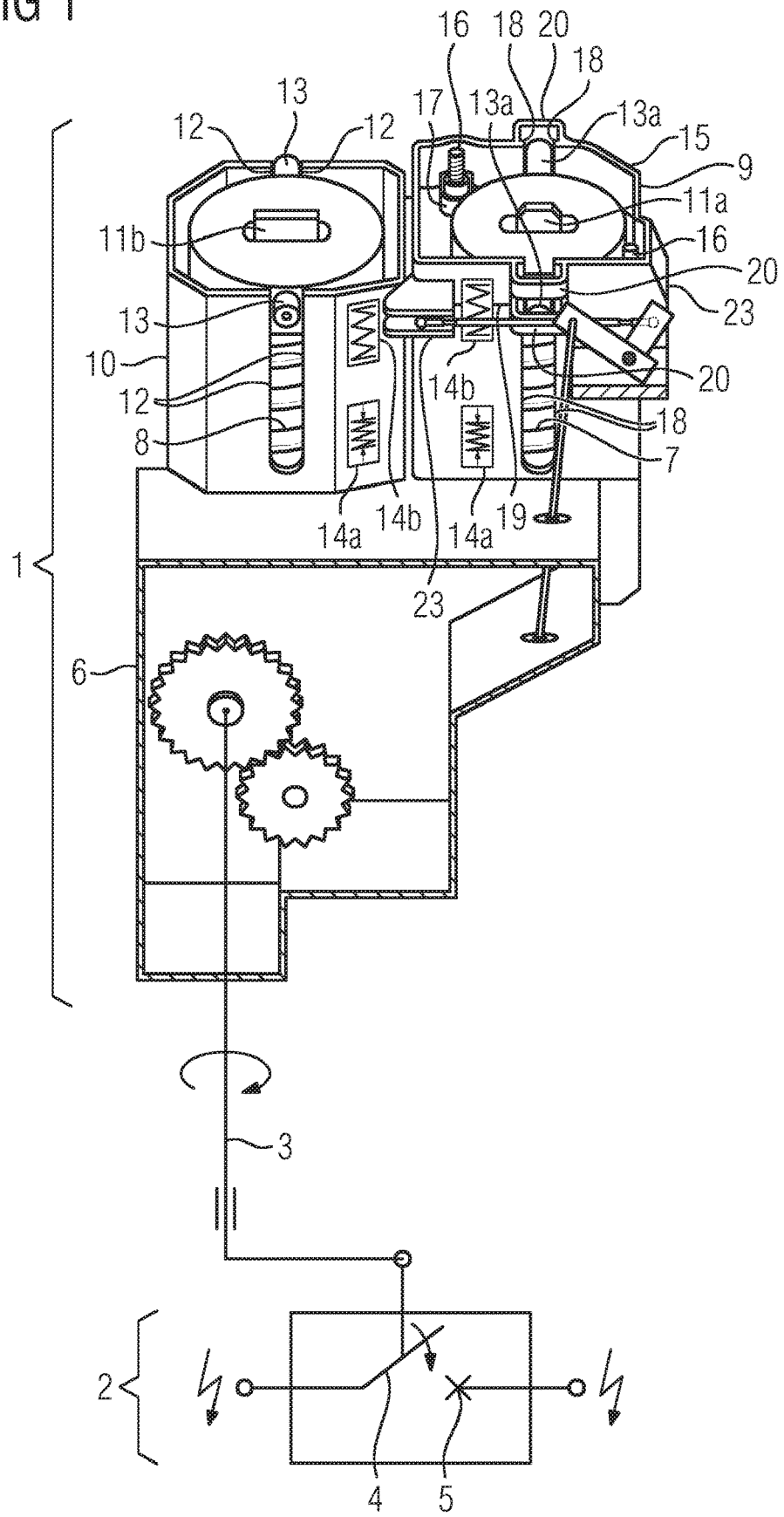

FIG. 1 shows a switching contact drive device 1, which is coupled to an electrical switching device 2 via a shaft 3. The electrical switching device 2 is, for example, a high-voltage circuit-breaker, which comprises a switching chamber, in which a first switching contact point 4 is moveably arranged relative to a second switching contact point 5. The two switching contact points 4, 5 constitute part of a current path, which can be closed or opened by means of the electrical switching device 2. To this end, the first switching contact point 4 is moveably mounted, and is connected to the shaft 3 via a kinematic chain. In the present case, the second switching contact point 5, by way of an example, is configured in a stationary arrangement. Additionally, electrical switching devices 2 can also be employed, in which both the first and the second switching contact point 4, 5 are driven. Embodiments of the switching contact points 4, 5 can vary, depending upon the type of switching chamber selected. For example, the switching chamber can be a vacuum switching tube, within which the switching contact points 4, 5 are moveable relative to one another, wherein the switching contact points 4, 5, for example, are configured as butt-connected axial magnetic field contacts. Alternatively, however, it can also be provided that the two switching contact points 4, 5 comprise a rated current section and an arcing section, and are arranged within an electrically insulating fluid for their part. The rated current sections of the switching contact points 4, 5 are protected by the arcing sections against severe erosion, for example associated with switching arcs.

The switching contact drive device comprises a transmission housing 6. In the present case, the transmission housing 6 is constituted, for example, in the form of a block or a plurality of shells, for the positioning of transmission components relative to one another. To this end, the transmission housing 6 comprises force conversions elements, such as a plurality of shafts on which, for example, gearwheels and couplings are mounted, which are operatively connected with one another in order to execute a force conversion within the transmission. The force conversion elements are ultimately connected to the shaft 3, via which a drive motion is transmitted to at least one of the switching contact points 4, 5 which are moveable relative to one another.

In order to generate a relative movement between the switching contact points 4, 5, the switching contact drive device 1 comprises a first energy store 7 and a second energy store 8. The two energy stores 7, 8 are respectively arranged in a first store housing 9 and a second store housing 10. In the present case, the two energy stores 7, 8 are configured as coil springs, which are compressed for the purposes of energy storage, and are expanded for the purposes of a release of the stored energy. The first store housing 9 encloses the first energy store 7. The second store housing 10 encloses the second energy store 8. The energy stores 7, 8, with respect to their coil axes, are enclosed on the shell side by the respective store housings 9, 10. The second store housing 10 is connected to the transmission housing 6, and is integrally molded. For example, in the context of a casting process, the second store housing 10 can be integrally cast.

In the present case, it is provided that, for safety reasons, charging of the second energy store 8 is executed directly, wherein the energy temporarily stored in the second energy store 8 is released, in order to execute the indirect charging of the first energy store 7. As a result, "recharging" of the first energy store 7 by the second energy store 8 is permitted. This increases the reliability of the switching contact drive device in that, additionally to the initiation of an ON/OFF switching operation, which is powered by the first energy store 7, re-tensioning or recharging of the first energy store 7 can be executed by means of the energy supply temporarily stored in the second energy store 8. The option is thus provided for a further increase in the number of independently executable switching operations of the switching contact points 4, 5 of the electrical switching device 2.

Compression of the first energy store 7 or the second energy store 8 is executed by a movement of a free end of the respective energy store 7, 8 against an abutment, which is constituted by a mating surface of the transmission housing 6. In order to execute the movement, a connecting rod 11*a*, 11*b* is coupled to one free end of the respective energy store 7, 8 in each case. The connecting rods 11*a*, 11*b* are routed through the coil windings of the first or second energy store 7, 8 in the direction of the abutment, i.e. in the direction of the transmission housing 6. Here, the connecting rods are correspondingly connected to the further force conversion elements of the transmission such that, as required, tensioning or tension relief can be executed via the respective connecting rod 11*a*, 11*b* and thus, additionally, a movement introduced for the tensioning of the energy store 7, 8, or energy released via the coupling rods 11*a*, 11*b*. In the second store housing 10, on the shell side, a gate passage 12 is arranged in diametrical opposition in each case. The gate passages 12 are respectively oriented in a linear profile, wherein the gate passages 12 are respectively swept by a sliding block 13, which projects into the respective gate passage 12. The sliding blocks 13 are arranged on a shaft, which is coupled to the connecting rod 11*b* such that a movement of the connecting rod 11*b*, and a resulting relative movement of the second energy store 8, is executed in a controlled manner by a sweep of the sliding block 13 in the gate passage 12. A compression or expansion of the second energy store 8 in a linear direction, i.e. in the direction of the coil windings of the second energy store 8, is permitted accordingly. The position of the sliding block 13 in the gate passages 12 represents the state of charge of the second energy store 8. Correspondingly, a charged symbol or a discharged symbol 14*a*, 14*b* is arranged in the corresponding region of the gate passage 12.

For the constitution of the first store housing 9 of the first energy store 7, an alternative variant of embodiment is preferred. In this case, a modular structure of the first store housing 9 is provided, wherein a first module 15 is employed. The first module 15 is represented in greater detail, in perspective views, in FIGS. 2 and 3. In the present case, the first store housing 9 comprises a single first module 15. The first module 15 is connected to the transmission housing 6, which constitutes a section (module) of the first store housing 9. The first store housing 9 is constituted by the cooperation of the section of the first store housing 9 which is provided by the transmission housing 6, and the first module 15. The first module 15 is connected by means of bolts 16, which project through fixing tabs 17, in an angularly rigid arrangement to the transmission housing 6. The first store housing 9 comprises further gate passages 18. The further gate passages 18 show a linear extension, and are essentially oriented in parallel with the gate passages 12 of the second store housing 10. The further gate passages 18 are thus constituted by the first module 15, and by the section of the transmission housing 6 to which the first module 15 is fitted. The further gate passages 18 thus traverse a joining point 19, which is arranged between a joining point surface 21 of the first module 15 and the joining point surface of the transmission housing 6 which constitutes a section of the first store housing 9.

Alternatively, it can also be provided that, instead of a molding of a section of the first store housing 9 onto the transmission housing 6, said section can also be constituted in the form of a separate module, which is correspondingly bolted onto the transmission housing 6. Thus, as required, and depending upon the axial extension or number of modules to be interconnected, store housings 9 of shorter or longer construction can be constituted for the first energy store 7. Correspondingly, storage springs of shorter or longer construction can be employed for the constitution of the first energy store 7. In order to ensure the mechanical stability of the first store housing 9, the respective section of the further gate passages 18, in the region of the first module 15, is bridged by brackets 20 such that, in each case, a further sliding block 13*a* can project into the respective gate passage 18, and guidance is permitted by means of the further gate passages 18. With respect to the function of the further sliding blocks 13*a* and the charged/discharged symbols 14*a*, 14*b*, comments with respect to the second store housing 10 apply mutatis mutandis.

Figure 2:
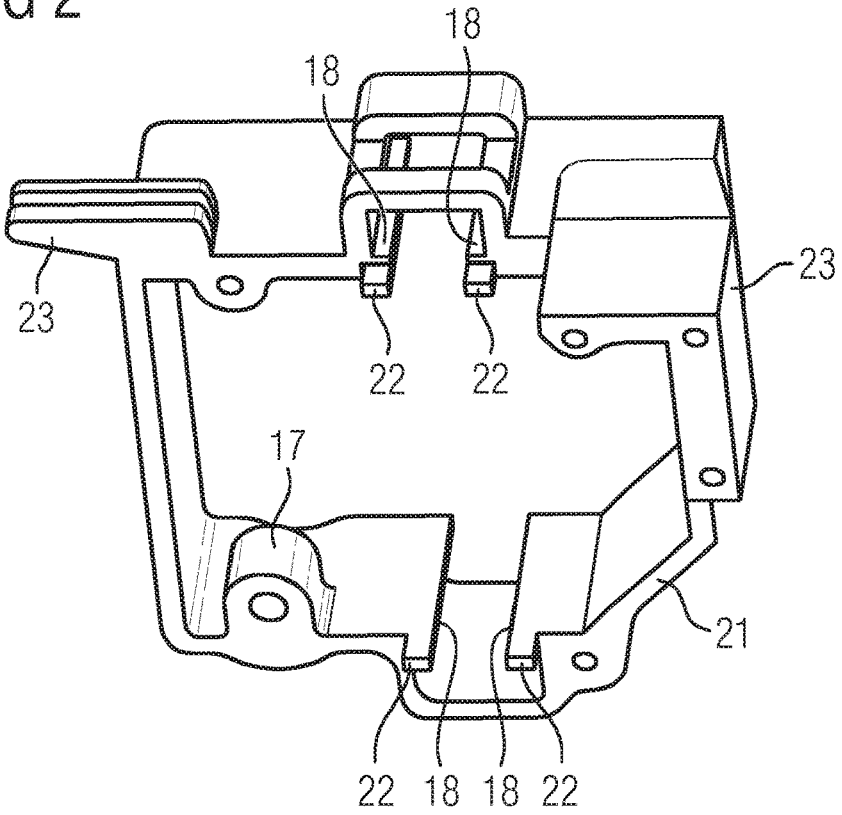

The structure of the first module 15 for the first store housing 9 will now be described in greater detail, with reference to FIGS. 2 and 3. In FIG. 2, a joining point surface 21 is arranged to face the viewer, along which the joining point 19 extends. In the joining point surface 21, or from the joining point surface 21, shoulders 22 project, which constitute a complementarily shaped mating arrangement. The shoulders 22 can project into a mating surface (e.g. a joining point surface) which is configured in alignment with the joining point surface 21, for example of a further module or the transmission housing 6, such that a stable transition for the gate passage 18 is constituted in the region of the joining point 19. Mounting flanges 17 permit a bolting of the first module 15, for example to the transmission housing 6. Moreover, at the periphery of the first module 15 of the first store housing 9, further moldings 23 are provided, by means of which, for example, a retention of alarm switches or a guide function for the drive elements of the alarm switches is possible. For the guidance of a drive element, for example a push rod, a slot-like recess, for example, can be arranged in one of the further moldings 23, in which a longitudinal guidance of a push rod for an alarm switch is executed.

Figure 3:
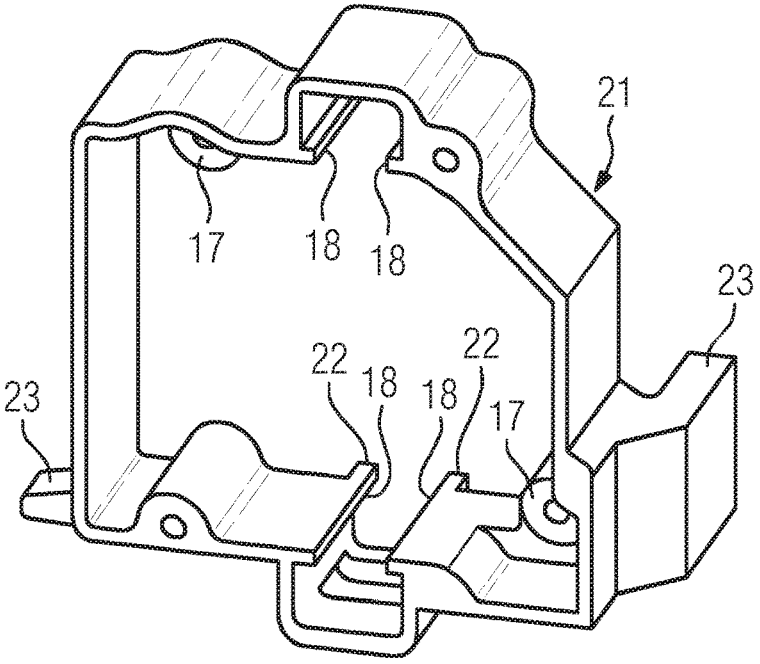
FIG. 3 shows an alternative perspective view, wherein the joining point surface in FIG. 2 is now averted from the viewer.

FIG. 3 shows an overhead view of the free end (c.f. FIG. 1) of the first module 15 of the first store housing 9. In FIG. 3, the joining point surface 21 which faces the viewer in FIG. 2 is averted from the viewer. Additionally to the recesses in the mounting flanges 17, the wall of the first module 15 can preferably incorporate recesses which are oriented in the direction of the gate passages 18, in which, for example, further fastening means can be positioned.

The invention claimed is:

1. A switching contact drive device, comprising:

a transmission with an energy store for an electrical switching device; and a store housing enclosing said energy store;

a joining point incorporated in said store housing transversely to a relative movement of said energy store, said store housing having a gate passage for guiding a movement of said energy store and said gate passage being disposed transversely to said joining point, said store housing having form-fitting elements, said gate passage being centered in a mating surface by means of said form-fitting elements;

a second store housing having a second energy store and diametrically opposed second gate passages being oriented in a linear profile, said second gate passages each being swept by a respective sliding block projecting therein, each said respective sliding block being arranged on a shaft coupled to a connecting rod and constructed for a movement of said connecting rod resulting in movement of said second energy store executed in a controlled manner by a sweep of said sliding block in said gate passage.

2. The switching contact drive device according to claim 1, wherein said store housing directs a relative movement of said energy store.

3. The switching contact drive device according to claim 1, wherein said transmission has a transmission housing and said store housing is mounted on a mating surface of said transmission housing.

4. The switching contact drive device according to claim 1, wherein said store housing directs a deformation of said energy store.

5. The switching contact drive device according to claim 1, wherein said gate passage has brackets bridging said gate passage.

6. The switching contact drive device according to claim 5, wherein said gate passage is two diametrically opposite gate passages.

7. An electrical switching device, comprising:

switching contact points, including a first switching contact point and a second switching contact point which are moveable relative to one another; and a switching contact drive device for generating a relative movement between said switching contact points, said switching contact drive device containing a transmission with an energy store and a store housing enclosing said energy store;

a joining point incorporated in said store housing transversely to a relative movement of said energy store, said store housing having a gate passage for guiding a movement of said energy store and said gate passage being disposed transversely to said joining point, said store housing having form-fitting elements, said gate passage being centered in a mating surface by means of said form-fitting elements;

a second store housing having a second energy store and diametrically opposed second gate passages being oriented in a linear profile, said second gate passages each being swept by a respective sliding block projecting therein, each said respective sliding block being arranged on a shaft coupled to a connecting rod and constructed for a movement of said connecting rod resulting in movement of said second energy store executed in a controlled manner by a sweep of said sliding block in said gate passage.

8. The switching contact drive device according to claim 7, wherein said gate passage has brackets bridging said gate passage.

9. The switching contact drive device according to claim 8, wherein said gate passage is two diametrically opposite gate passages.

* * * * *